US009790741B2

(12) United States Patent
Gaikwad et al.

(10) Patent No.: US 9,790,741 B2
(45) Date of Patent: Oct. 17, 2017

(54) DOWNHOLE DRILLING ASSEMBLY HAVING A HYDRAULICALLY ACTUATED CLUTCH AND METHOD FOR USE OF SAME

(71) Applicant: Halliburton Energy Services Inc., Houston, TX (US)

(72) Inventors: Rahul Ramchandra Gaikwad, Maharashtra (IN); Puneet Agarwal, Uttar Pradesh (IN)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/648,561

(22) PCT Filed: Dec. 29, 2012

(86) PCT No.: PCT/US2012/072207

§ 371 (c)(1),
(2) Date: May 29, 2015

(87) PCT Pub. No.: WO2014/105072

PCT Pub. Date: Jul. 3, 2014

(65) Prior Publication Data

US 2015/0345221 A1 Dec. 3, 2015

(51) Int. Cl.
*E21B 7/00* (2006.01)
*E21B 17/04* (2006.01)
(Continued)

(52) U.S. Cl.
CPC ..... *E21B 7/002* (2013.01); *E21B 4/02* (2013.01); *E21B 17/04* (2013.01); *E21B 3/00* (2013.01); *E21B 7/04* (2013.01)

(58) Field of Classification Search
CPC ... E21B 4/00; E21B 4/02; E21B 17/04; E21B 7/002
See application file for complete search history.

(56) References Cited

U.S. PATENT DOCUMENTS 4,276,944 A 7/1981 Geczy
4,299,296 A 11/1981 Geczy
(Continued)

FOREIGN PATENT DOCUMENTS

WO 2014105072 7/2014

OTHER PUBLICATIONS

First Office Action issued by theState Intellectual Property Office of the People's Republic of China regarding Chinese Patent Application No. 2012800774035, dated Feb. 16, 2016, 13 pages.
(Continued)

*Primary Examiner* — David Andrews
*Assistant Examiner* — Kristyn Hall
(74) *Attorney, Agent, or Firm* — Haynes and Boone, LLP

(57) ABSTRACT

A downhole drilling assembly includes a drill string having an inner fluid passageway. A fluid motor disposed within the drill string has a rotor operable to rotate relative to a stator in response to a circulating fluid received via the inner fluid passageway. A drive shaft and drill bit are operably associated with and operable to rotate with the rotor. A hydraulically actuated clutch disposed within the drill string has a first configuration, wherein a first clutch assembly is disengaged from a second clutch assembly such that the drive shaft and drill bit rotate relative to the drill string and, a second configuration, wherein the first clutch assembly engages the second clutch assembly responsive to hydraulic pressure generated by rotation of the drill string such that the drive shaft and drill bit rotate with the drill string.

20 Claims, 7 Drawing Sheets

(51) Int. Cl.

| | |
|---|---|
| ***E21B 4/02*** | (2006.01) |
| *E21B 3/00* | (2006.01) |
| *E21B 7/04* | (2006.01) |

(56) References Cited

U.S. PATENT DOCUMENTS

| | | | | |
|---|---|---|---|---|
| 7,036,580 | B2 * | 5/2006 | McGarian ..... | E21B 23/04 166/117.7 |
| 2006/0254824 | A1 | 11/2006 | Horst et al. | |
| 2008/0264692 | A1 | 10/2008 | Underwood et al. | |
| 2009/0183921 | A1 | 7/2009 | Gurjar et al. | |
| 2010/0108383 | A1 | 5/2010 | Hay et al. | |
| 2013/0313022 | A1 | 11/2013 | Kirkhope et al. | |

OTHER PUBLICATIONS

Examination Report No. 1 issued by the Australian Government IP Australia regarding Australian Patent Application No. 2012397800, dated Dec. 5, 2015, 3 pages.

International Search Report and Written Opinion issued by the Korean Intellectual Property Office regarding application PCT/US2012/072207, dated Sep. 2, 2013, 14 pages.

Supplementary European Search Report issued by the European Patent Office regarding EP Patent Application No. 12891283, dated Aug. 16, 2016, 7 pages.

* cited by examiner

DOWNHOLE DRILLING ASSEMBLY HAVING A HYDRAULICALLY ACTUATED CLUTCH AND METHOD FOR USE OF SAME

CROSS REFERENCE

This application is a United States national phase application of co-pending international patent application number PCT/US2012/072207, filed Dec. 29, 2012, the entire disclosure of which is hereby incorporated herein by reference.

TECHNICAL FIELD OF THE PRESENT DISCLOSURE

This disclosure relates, in general, to equipment utilized in conjunction with operations performed in relation to subterranean wells and, in particular, to a downhole drilling assembly for use in directional drilling having a hydraulically actuated clutch mechanism for selectively transmitting torque from the drill string to the drive shaft.

BACKGROUND

Without limiting the scope of the present disclosure, its background will be described with reference to operating a positive displacement fluid motor during downhole directional drilling operations, as an example.

In a typical downhole drilling motor, power generation is based upon the Moineau pump principle. In this type of motor design, a rotor and stator assembly converts the hydraulic energy of a pressurized circulating fluid to the mechanical energy of a rotating shaft. The rotor and stator are typically of lobed design, with the rotor and stator having similar lobe profiles. The rotor is generally formed from steel having one less lobe than the stator, which is typically lined with an elastomer layer.

In general, the power section may be categorized based upon the number of lobes and effective stages. The rotor and stator lobes are of a helical configuration with one stage equating to the linear distance of a full wrap of the stator helix. The rotor and stator lobes and helix angles are designed such that the rotor and stator seal at discrete intervals, which results in the creation of axial fluid chambers or cavities that are filled by the pressurized circulating fluid. The action of the pressurized circulating fluid causes the rotor to rotate and precess within the stator. Motor power characteristics are generally a function of the number of lobes, lobe geometry, helix angle and number of effective stages. Motor output torque is directly proportional to the differential pressure developed across the rotor and stator. Bit rotation speed is directly proportional to the circulating rate of the pressurized circulating fluid.

It has been found, however, that typical rotor and stator assemblies used in downhole drilling motors have certain maximum torque output limitations. For example, operations above a maximum differential pressure may cause fluid leakage between the rotor and stator seals which may result in no rotation of the bit due to the rotor becoming stationary or stalling in the stator. As such, in the event the drill bit becomes stuck, it is not uncommon for the torque required to free the bit to exceed the maximum torque output of conventional downhole drilling motors. In such cases, one solution has been to release the downhole drilling motor and drill assembly in the well and perform a sidetrack operation to bypass the stuck components and continue drilling the well. While this solution enables continued drilling, it is not desirable as it is time consuming and expensive.

Therefore, a need has arisen for an improved downhole drilling assembly for use in directional drilling operations. A need has also arisen for such an improved downhole drilling assembly that is capable of transmitting sufficient torque to free a stuck bit. Further, a need has also arisen for such an improved downhole drilling assembly that is capable of continued drilling operations after the stuck bit is freed.

SUMMARY OF THE DISCLOSURE

The present disclosure is directed to an improved downhole drilling assembly for use in directional drilling operations. The improved downhole drilling assembly of the present disclosure is capable of transmitting sufficient torque to free a stuck bit. In addition, the improved downhole drilling assembly of the present disclosure is capable of continued drilling operations after the stuck bit is freed.

In one aspect, the present disclosure is directed to a downhole drilling assembly including a drill string having an inner fluid passageway. A fluid motor is disposed within the drill string. The fluid motor has a rotor operable to rotate relative to a stator in response to a circulating fluid received via the inner fluid passageway of the drill string. A drive shaft is operably associated with the rotor. The drive shaft rotates responsive to rotation of the rotor. A drill bit is operably associated with the drive shaft. The drill bit rotates responsive to rotation of the drive shaft. A hydraulically actuated clutch disposed within the drill string has a first clutch assembly operable to rotate with the drill string and a second clutch assembly operable to rotate with the drive shaft. In a first configuration, the first clutch assembly is disengaged from the second clutch assembly such that the drive shaft and drill bit rotate relative to the drill string. In a second configuration, the first clutch assembly engages the second clutch assembly responsive to hydraulic pressure generated by rotation of the drill string such that the drive shaft and drill bit rotate with the drill string.

In one embodiment, the hydraulically actuated clutch may include a swash plate pump operable to generate the hydraulic pressure responsive to rotation of the drill string. In some embodiments, the first clutch assembly may be a first clutch plate and the second clutch assembly may be a second clutch plate. In these embodiments, a piston may be axially shifted responsive to the hydraulic pressure to shift the first clutch assembly into engagement with the second clutch assembly. In other embodiments, the first clutch assembly may be a first castellated element and the second clutch assembly may be a second castellated element. In these embodiments, a piston may be axially shifted responsive to the hydraulic pressure to move the castellated elements into engagement with one another. Also, in these embodiments, a spring may be used to bias the castellated elements toward disengagement with one another.

In another aspect, the present disclosure is directed to a downhole drilling assembly including a drill string having an inner fluid passageway. A fluid motor is disposed within the drill string. The fluid motor has a rotor operable to rotate relative to a stator in response to a circulating fluid received via the inner fluid passageway of the drill string. A drive shaft is operably associated with the rotor. The drive shaft rotates responsive to rotation of the rotor. A drill bit is operably associated with the drive shaft. The drill bit rotates responsive to rotation of the drive shaft. A hydraulically actuated clutch disposed within the drill string has a swash plate pump, a first clutch assembly operable to rotate with the drill string and a second clutch assembly operable to rotate with the drive shaft. In a first configuration, the first clutch assembly is disengaged from the second clutch assembly such that the drive shaft and drill bit rotate relative to the drill string. In a second configuration, the first clutch assembly engages the second clutch assembly responsive to hydraulic pressure generated by the swash plate pump in response to rotation of the drill string such that the drive shaft and drill bit rotate with the drill string.

In a further aspect, the present disclosure is directed to a method of operating a downhole drilling assembly. The method includes disposing a drill string having an inner fluid passageway and a downhole drilling motor assembly in a wellbore; pumping a circulating fluid through the inner fluid passageway and the downhole drilling motor assembly; rotating a rotor relative to a stator of the downhole drilling motor assembly responsive to the circulating fluid; rotating a drive shaft responsive to the rotation of the rotor; rotating a drill bit relative to the drill string responsive to the rotation of the drive shaft; rotating the drill string; engaging a hydraulically actuated clutch responsive to hydraulic pressure generated by the rotation of the drill string; and rotating a drill bit with the drill string responsive to the rotation of the drill string.

The method may also include generating hydraulic pressure responsive to operating a swash plate pump; engaging a first clutch assembly operably associated with the drill pipe with a second clutch assembly operably associated with the drive shaft; engaging a first clutch plate operably associated with the drill pipe with a second clutch plate operably associated with the drive shaft; engaging a first castellated element operably associated with the drill pipe with a second castellated element operably associated with the drive shaft; axially shifting a piston responsive to the hydraulic pressure and/or overcoming a spring force responsive to the hydraulic pressure.

BRIEF DESCRIPTION OF THE DRAWINGS

For a more complete understanding of the present disclosure, reference is now made to the detailed description of the various embodiments along with the accompanying figures in which corresponding numerals in the different figures refer to corresponding parts and in which.

DETAILED DESCRIPTION

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

Figure 1:
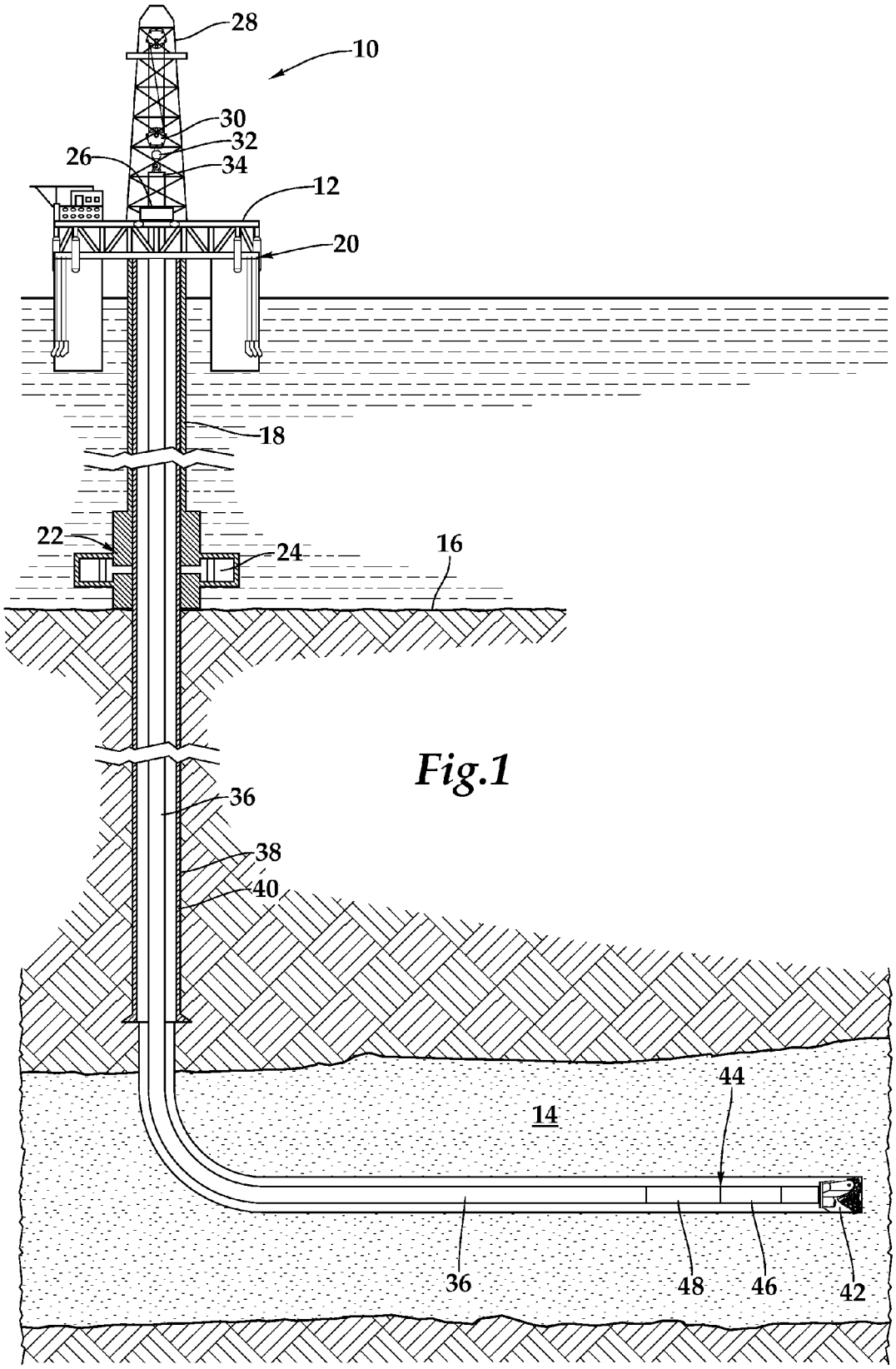
FIG. 1 is a schematic illustration of an offshore platform operating a downhole drilling assembly.

Referring initially to FIG. 1, a directional drilling operation is being performed from an offshore oil or gas platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising, lowering and rotating pipe strings, such drill string 36.

A wellbore 38 extends through the various earth strata including formation 14. The upper substantially horizontal portion of wellbore 38 has a casing string 40 cemented therein. At a distal end of a substantially horizontal section of wellbore 38, drill string 36 include drill bit 42. Disposed uphole of drill bit 42 in drill sting 36 is a downhole drilling assembly 44 including a power assembly 46 and a hydraulically actuated clutch assembly 48. In operation, circulating fluid is pumped through an interior fluid passageway of drill string 36 to downhole drilling assembly 44. Power assembly 46 converts the hydraulic energy of the circulating fluid to mechanical energy in the form of a rotating rotor. The rotor is coupled to drill bit 42 via a drive shaft to cause rotation of drill bit 42, which allows for wellbore 38 to be extended. In the event drill bit 42 becomes stuck in the wellbore 38, rotation of drill string 36 is operable to engage hydraulically actuated clutch assembly 48 such that rotation of drill string 36 imparts rotation to the drive shaft with sufficient torque to free the stuck drill bit 42. After freeing drill bit 42, rotation of drill string 36 may cease which disengages hydraulically actuated clutch assembly 48 such that normal drilling operations may continue, wherein the circulating fluid being pumped through drill string 36 and downhole drilling assembly 44 powers rotation of drill bit 42.

Even though FIG. 1 depicts a horizontal wellbore, it should be understood by those skilled in the art that the various principles discussed in the present disclosure are equally well suited for use in wellbores having other orientations including vertical wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the disclosed principles are also applicable to onshore operations.

Referring now to FIGS. 2A-2F, therein is depicted one embodiment of a downhole drilling assembly that is generally designated 100. In the illustrated embodiment, downhole drilling assembly 100 includes an outer housing having a plurality of housing sections that are preferably threadably and sealingly coupled together and form a lower portion of the drill string. In the illustrated embodiment, the outer housing includes an oil reservoir housing section 102, a hydraulic pump housing section 104, a clutch housing section 106, a bearing housing section 108, a rotor extension housing section 110, a universal joint housing section 112, a power section housing section 114, a universal joint housing section 116 and a bearing housing section 118. Downhole drilling assembly 100 has an inner fluid passageway 120 that is in fluid communication with the inner fluid passageway of the drill string such that circulating fluid from the surface may be pumped into downhole drilling assembly 100 via the inner fluid passageway of the drill string. Inner fluid passageway 120 is defined within an inner mandrel 122, a rotor extension 124 and a connector sub 126. Connector sub 126 includes a plurality of ports 128 that communicate the circulating fluid into an annular region 130 between universal joint housing section 112 and a universal joint 132. The circulating fluid then enters the power section of downhole drilling assembly 100 traveling in the regions 134 between an internally profiled stator 136 and an externally profiled rotor 138 before being discharged into an annular region 140 between universal joint housing section 116 and a universal joint 142. The circulating fluid then enters an inner fluid passageway 144 in drive shaft 146 via ports 148 of connector sub 150. The circulating fluid would then pass through the drill bit (not pictured) connected to drill bit box 152 and return to the surface via the wellbore annulus.

In the illustrated embodiment, inner mandrel 122 and rotor extension 124 are preferably threadably and sealingly coupled together. Rotor extension 124, connector sub 126, universal joint 132, rotor 138, universal joint 142, connector sub 150 and drive shaft 146 are preferably threadably coupled together. Together, inner mandrel 122, rotor extension 124, connector sub 126, universal joint 132, rotor 138, universal joint 142, connector sub 150 and drive shaft 146 may be referred to as a rotating assembly. Universal joint 132 provides an articulating connection between connector sub 126 and rotor 138. Likewise, universal joint 142 provides an articulating connection between rotor 138 and connector sub 150. The articulating connections are designed to enable the eccentric motion of rotor 138 to become rotary motion in the remainder of the rotating assembly.

Oil reservoir housing section 102 includes a fluid reservoir 154 preferably containing a clean fluid such as a hydraulic fluid. Disposed between hydraulic pump housing section 104 and inner mandrel 122 is a hydraulic pump depicted as a swash plate pump assembly 156. Swash plate pump assembly 156 includes a swash plate 158 that is securably coupled to and operable to rotate with inner mandrel 122. Swash plate 158 is positioned such that it defines a plane at an angle to the longitudinal axis of downhole drilling assembly 100. Swash plate pump assembly 156 also includes a plurality of circumferentially distributed pistons 160, only two of which are visible in FIG. 2A. In the illustrated embodiment, pistons 160 are supported by oil reservoir housing section 102 and are operable to rotate therewith. Each piston 160 is operable to move independently of the others in the axial direction of downhole drilling assembly 100 when pushed by swash plate 158 enabling each piston 160 to reciprocate within respective cylinders 162 against the bias force of respective springs 164. Each piston 160 includes the appropriate valving such that axial reciprocation thereof causes fluid to be drawn from a chamber 166 in fluid communication with fluid reservoir 154 and discharged into a chamber 168 under pressure. A bleed line connects chamber 166 and chamber 168 with appropriate valving positioned therein to maintain the desired pressure in chamber 168 while allowing fluid to recirculate through the system.

Disposed between clutch housing section 106 and inner mandrel 122 is an annular piston 170 and a spring 172 that biases annular piston 170 in the uphole direction. In the illustrated embodiment, an upper portion of annular piston 170 is slidably and sealingly received within hydraulic pump housing section 104. Disposed between clutch housing section 106 and rotor extension 124 is a hydraulically actuated clutch 174. In the illustrated embodiment, clutch 174 includes an outer clutch assembly depicted as outer clutch plate 176 that is coupled to clutch housing section 106 via a splined connection. Outer clutch plate 176 is operable to slide relative to clutch housing section 106 responsive to axial movement of annular piston 170 and is operable to rotate with clutch housing section 106. Clutch 174 also includes an inner clutch assembly depicted as inner clutch plate 178 that is securably coupled to and operable to rotate with rotor extension 124. A bearing assembly 180 is positioned between clutch housing section 106 and rotor extension 124. A bearing assembly 182 is positioned between bearing housing section 108 and rotor extension 124. A bearing assembly 184 is positioned between bearing housing section 118 and drive shaft 146.

Figure 2A:
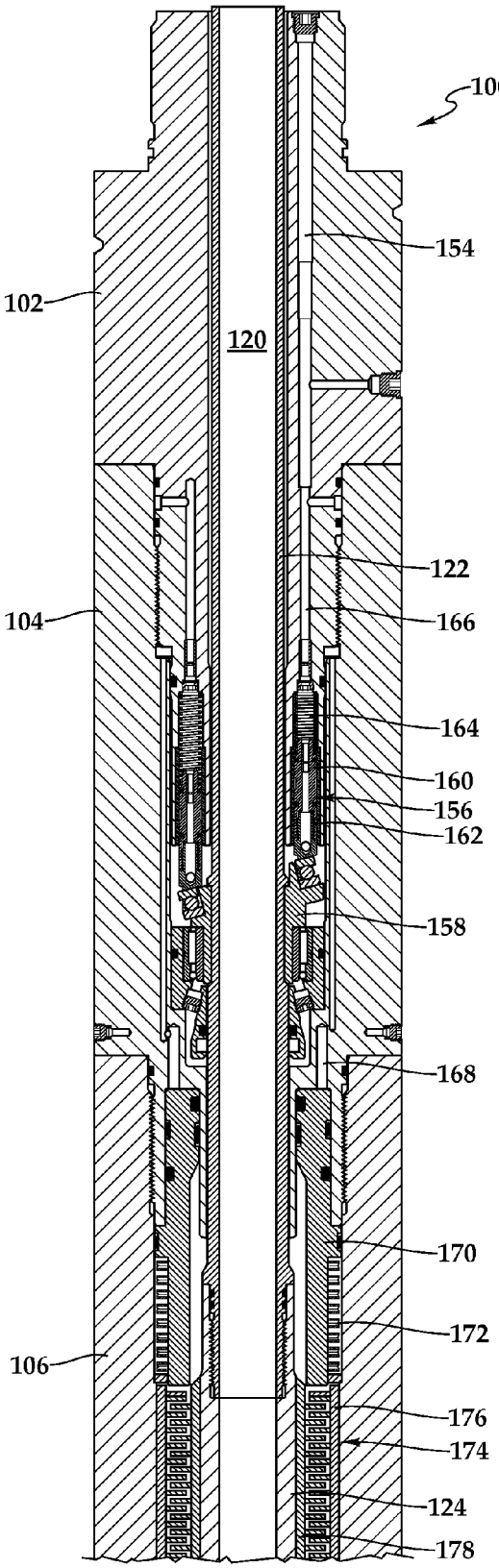
FIGS. 2A-2F are cross sectional views of consecutive axial sections of a downhole drilling assembly.
Figure 2B:
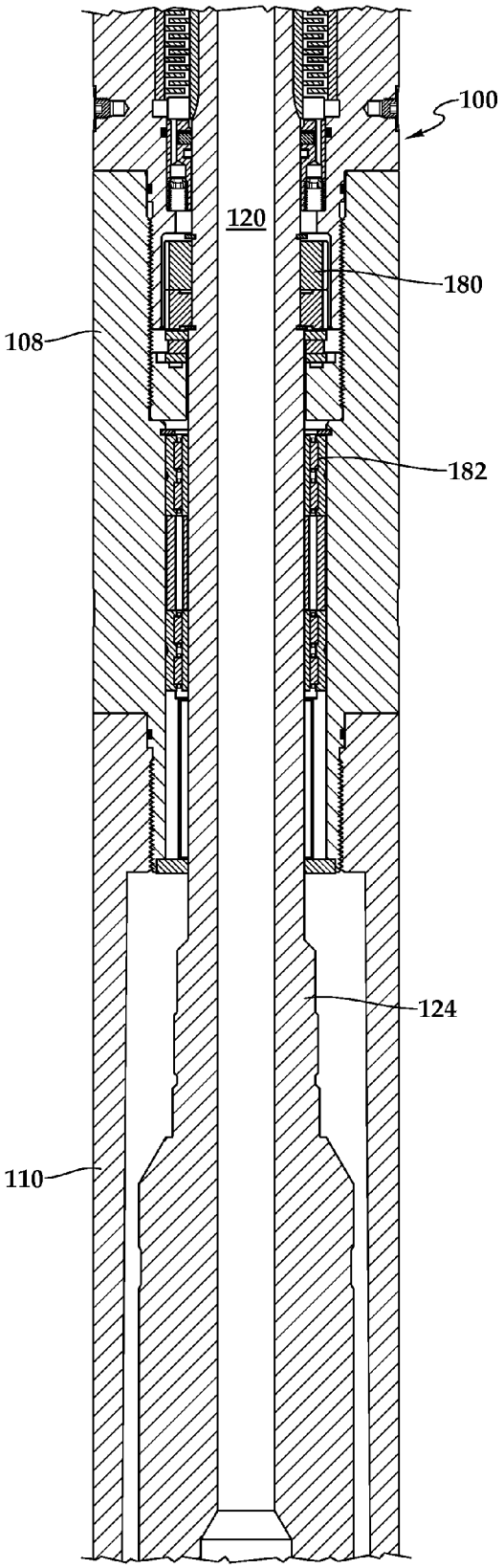
Figure 2C:
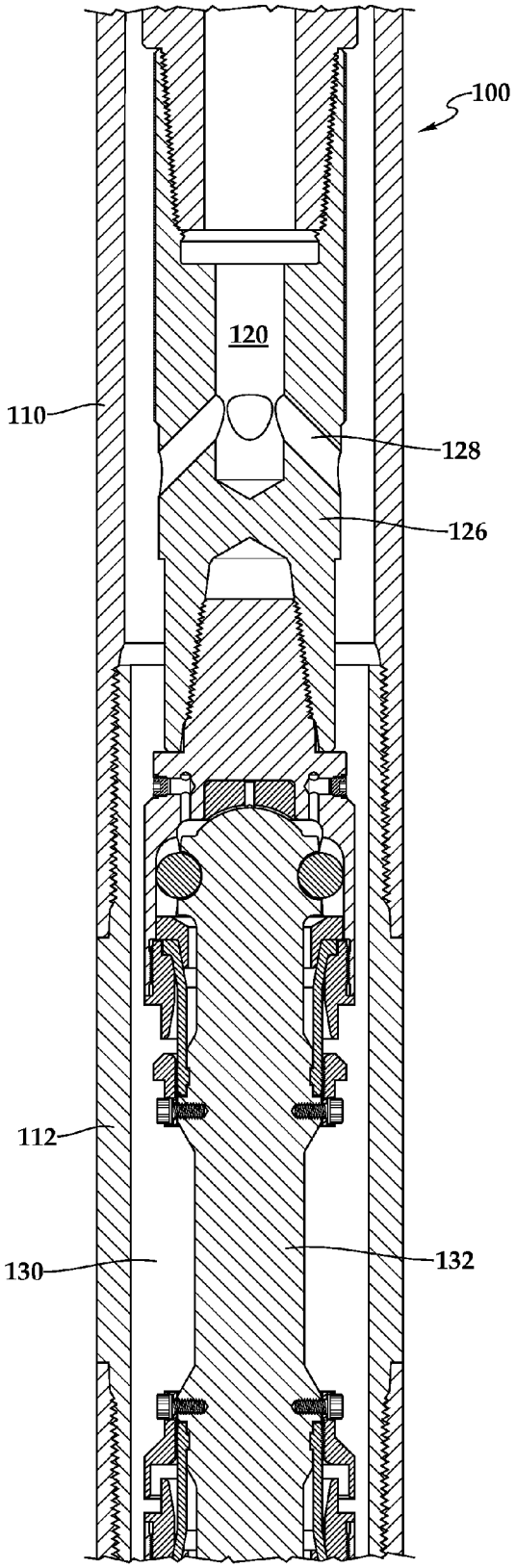
Figure 2D:
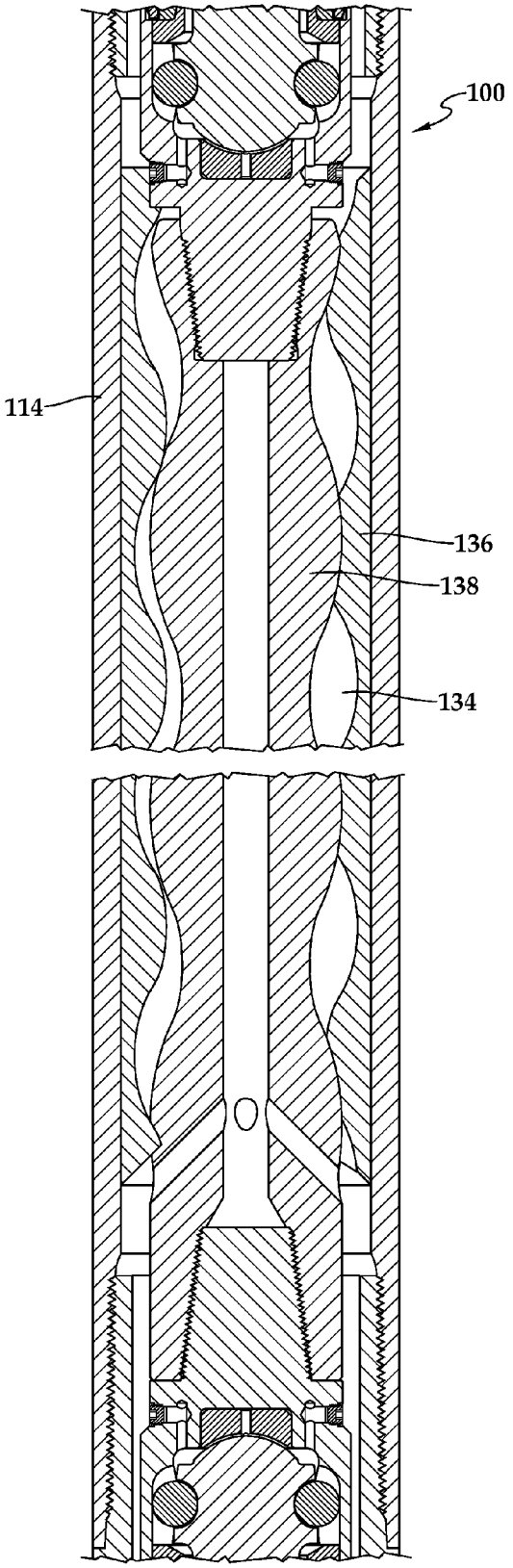
Figure 2E:
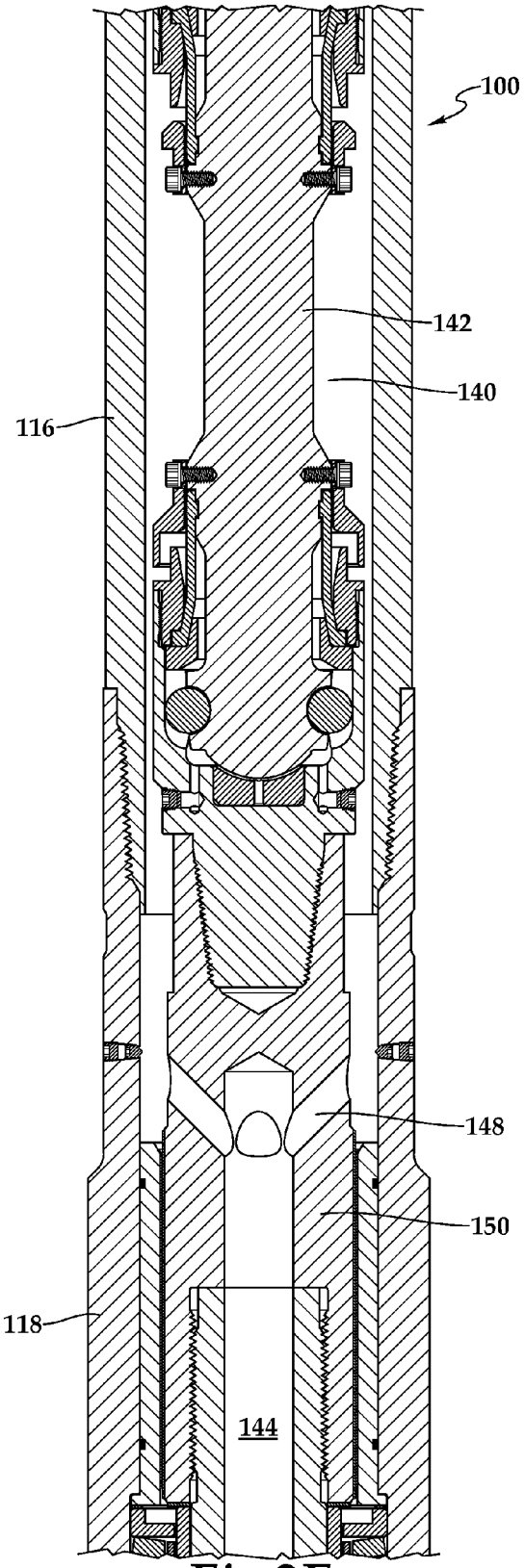
Figure 2F:
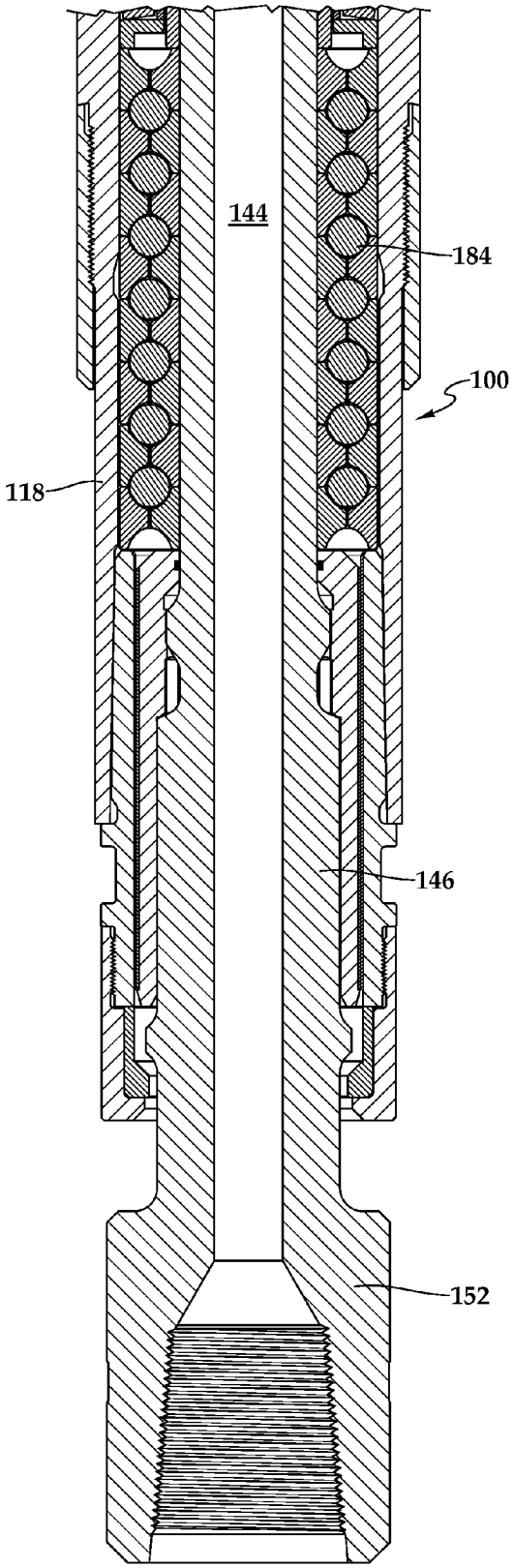

The operation of downhole drilling assembly 100 will now be described. During normal drilling operations, a circulating fluid is pumped down the inner fluid passageway of the drill string into inner fluid passageway 120 of downhole drilling assembly 100. The circulating fluid may be fresh or salt water-based, oil-based, oil emulsion or the like and is selected based upon factors that are known to those skilled in the art. The circulating fluid passes through inner fluid passageway 120 then enters annular region 130 via ports 128, as best seen in FIG. 2C. The circulating fluid then enters the power section of downhole drilling assembly 100, as best seen in FIG. 2D. Preferably, stator 136 has a multi-staged, profiled inner surface defining a plurality of stator lobes that have a helical configuration wherein each stage is defined by the linear distance of one full wrap of the stator helix. Those skilled in the art will understand that the number of stator lobes used in a particular power section will be determine based upon factors including the desired speed of rotation and the desired torque wherein power sections of the same diameter having fewer stator lobes generally operate at higher speeds and deliver lower torques as compared to power sections having a greater number stator lobes that tend to operate at lower speeds but deliver greater torques.

Rotor 138 has a profiled outer surface that closely matches the profiled inner surface of stator 136 to provide a close fitting relationship. The profiled outer surface of rotor 138 defines a plurality of rotor lobes that have a helical configuration. The number of rotor lobes used in a particular power section will be determine based upon the number of stator lobes in that power section with the number of rotor lobes being one less than the number of stator lobes. For example, if the number of stator lobes is (n) then the number of rotor lobes is (n−1). Due to the helical lobed design of stator 136 and rotor 138, seals are created at discrete intervals therebetween, which result in the creation of axial fluid chambers or cavities 134 that are filled by the circulating fluid. The action of the circulating fluid causes rotor 138 to rotate and precess within stator 136. The circulating fluid then exits the power section and travels through annular region 140 and inner fluid passageway 144. The circulating fluid then passing through and cools the drill bit (not pictured), then returns to the surface via the wellbore annulus carrying cutting from the drilling process. Responsive to the rotation of rotor 138, universal joint 142 and connector sub 150 are rotated, which in turn rotates drive shaft 146 and the drill bit. In this manner, downhole drilling assembly 100 is operable to lengthen the wellbore. It should be noted that during normal drilling operations, rotation of rotor 138 also rotates rotor extension 124 and inner mandrel 122. As such, the rotating assembly rotates independent of the outer housing which may or may not be rotating. The relative speed of rotation between the rotating assembly and the outer housing, however, is not sufficient to generate enough oil pressure in swash plate pump assembly 156 to overcome the spring force of spring 172 to shift annular piston 170 and engage clutch 174.

In the event the drill bit becomes stuck, it may not be possible to free the drill bit with torque supplied from the power section of downhole drilling assembly 100. The maximum torque output of downhole drilling assembly 100 is limited by the maximum differential pressure the power section is able to withstand without fluid leakage between the sealing surfaces of rotor 138 and stator 136. If the power section of downhole drilling assembly 100 is not able to free the stuck drill bit, however, downhole drilling assembly 100 is nonetheless able to free the stuck drill bit by engaging the hydraulically actuated clutch section and rotating the drill bit responsive to rotation of the drill string. More specifically, the drill string is rotated at the surface which causes the outer housing of downhole drilling assembly 100 to rotate. This rotation causes pistons 160 to be rotated about the longitudinal axis of downhole drilling assembly 100. As pistons 160 are rotated, they also reciprocate axially due to interaction with the angled surface of swash plate 158 causing a pumping action which communicates fluid from chamber 166 into chamber 168 under pressure. The pressurized fluid acts on an upper surface of annular piston 170. When the rate of rotation of swash plate pump assembly 156 is sufficient to generate the pressure required to overcome the spring force of spring 172, annular piston 170 axially shifts in the downhole direction.

Prior to this shift, outer clutch plate 176 is rotating with the outer housing while inner clutch plate 178 is stationary. When annular piston 170 axially shifts in the downhole direction, annular piston 170 contacts outer clutch plate 176 which is shifted in the downhole direction to engage inner clutch plate 178. Once engaged, friction between outer clutch plate 176 and inner clutch plate 178 encourages inner clutch plate 178 to rotate. As inner clutch plate 178 is operably coupled to the drill bit by rotor extension 124, connector sub 126, universal joint 132, rotor 138, universal joint 142, connector sub 150 and drive shaft 146, torque from rotation of the drill string is transferred to drive shaft 146 and the drill bit by hydraulically actuated clutch 174. In this configuration, the torque applied to drive shaft 146 and the drill bit from the surface via rotation of the drill string can be significantly greater than the torque which can be generated by the power section of downhole drilling assembly 100. Once the bit is freed, the relative speed of rotation between the rotating assembly and the outer housing declines which reduces the hydraulic pressure acting on the upper surface of annular piston 170. When the pressure is no longer sufficient to overcome the spring force of spring 172, annular piston 170 axially shifts in the uphole direction which disengages outer clutch plate 176 from inner clutch plate 178. Downhole drilling assembly 100 has now returned to its normal operating configuration such that circulating fluid pumped through downhole drilling assembly 100 causes the drill bit to rotate, thereby enabling downhole drilling assembly 100 to further lengthen the wellbore.

Referring now to FIGS. 3A-3F, therein is depicted one embodiment of a downhole drilling assembly that is generally designated 200. In the illustrated embodiment, downhole drilling assembly 200 includes an outer housing having a plurality of housing sections that are preferably threadably and sealingly coupled together and form a lower portion of the drill string. In the illustrated embodiment, the outer housing includes an oil reservoir housing section 202, a hydraulic pump housing section 204, a clutch housing section 206, a bearing housing section 208, a rotor extension housing section 210, a universal joint housing section 212, a power section housing section 214, a universal joint housing section 216 and a bearing housing section 218. Downhole drilling assembly 200 has an inner fluid passageway 220 that is in fluid communication with the inner fluid passageway of the drill string such that circulating fluid from the surface may be pumped into downhole drilling assembly 200 via the inner fluid passageway of the drill string. Inner fluid passageway 220 is defined within an inner mandrel 222, a rotor extension 224 and a connector sub 226. Connector sub 226 includes a plurality of ports 228 that communicate the circulating fluid into an annular region 230 between universal joint housing section 212 and a universal joint 232. The circulating fluid then enters the power section of downhole drilling assembly 200 traveling in the regions 234 between an internally profiled stator 236 and an externally profiled rotor 238 before being discharged into an annular region 240 between universal joint housing section 216 and a universal joint 242. The circulating fluid then enters an inner fluid passageway 244 in drive shaft 246 via ports 248 of connector sub 250. The circulating fluid would then pass through the drill bit (not pictured) connected to drill bit box 252 and return to the surface via the wellbore annulus.

In the illustrated embodiment, inner mandrel 222 and rotor extension 224 are preferably threadably and sealingly coupled together. Rotor extension 224, connector sub 226, universal joint 232, rotor 238, universal joint 242, connector sub 250 and drive shaft 246 are preferably threadably coupled together. Together, inner mandrel 222, rotor extension 224, connector sub 226, universal joint 232, rotor 238, universal joint 242, connector sub 250 and drive shaft 246 may be referred to as a rotating assembly. Universal joint 232 provides an articulating connection between connector sub 226 and rotor 238. Likewise, universal joint 242 provides an articulating connection between rotor 238 and connector sub 250. The articulating connections are designed to enable the eccentric motion of rotor 238 to become rotary motion in the remainder of the rotating assembly.

Oil reservoir housing section 202 includes a fluid reservoir 254 preferably containing a clean fluid such as a hydraulic fluid. Disposed between hydraulic pump housing section 204 and inner mandrel 222 is a hydraulic pump depicted as a swash plate pump assembly 256. Swash plate pump assembly 256 includes a swash plate 258 that is securably coupled to and operable to rotate with inner mandrel 222. Swash plate 258 is positioned such that it defines a plane at an angle to the longitudinal axis of downhole drilling assembly 200. Swash plate pump assembly 256 also includes a plurality of circumferentially distributed pistons 260, only two of which are visible in FIG. 3A. In the illustrated embodiment, pistons 260 are supported by oil reservoir housing section 202 and are operable to rotate therewith. Each piston 260 is operable to move independently of the others in the axial direction of downhole drilling assembly 200 when pushed by swash plate 258 enabling each piston 260 to reciprocate within respective cylinders 262 against the bias force of respective springs 264. Each piston 260 includes the appropriate valving such that axial reciprocation thereof causes fluid to be drawn from a chamber 266 in fluid communication with fluid reservoir 254 and discharged into a chamber 268 under pressure. A bleed line connects chamber 266 and chamber 268 with appropriate valving positioned therein to maintain the desired pressure in chamber 268 while allowing fluid to recirculate through the system.

Disposed between clutch housing section 206 and inner mandrel 222 is an annular piston 270 and a spring 272 that biases annular piston 270 in the uphole direction. In the illustrated embodiment, an upper portion of annular piston 270 is slidably and sealingly received within hydraulic pump housing section 204 and is operable to rotate therewith. Disposed between clutch housing section 206 and rotor extension 224 is a hydraulically actuated clutch 274 depicted in side view for clarity. In the illustrated embodiment, clutch 274 includes an upper clutch assembly depicted as upper castellated element 276 that is coupled to clutch housing section 206 via a splined connection and is operable to rotate therewith. Upper castellated element 276 is operable to slide relative to clutch housing section 206 in response to axial movement of annular piston 270 which acts against a spring force used to bias clutch 274 toward disengagement. Clutch 274 also includes a lower clutch assembly depicted as lower castellated element 278 that is securably coupled to and operable to rotate with rotor extension 224. A bearing assembly 280 is positioned between clutch housing section 206 and rotor extension 224. A bearing assembly 282 is positioned between bearing housing section 208 and rotor extension 224. A bearing assembly 284 is positioned between bearing housing section 218 and drive shaft 246.

Figure 3A:
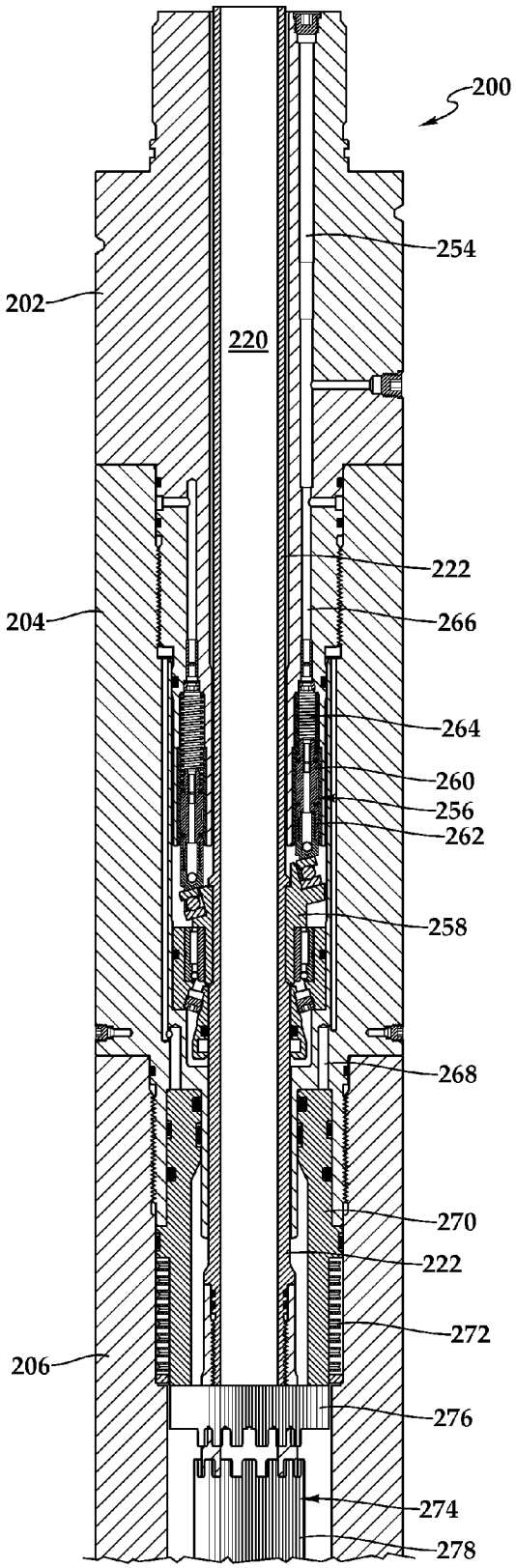
FIGS. 3A-3F are cross sectional views of consecutive axial sections of a downhole drilling assembly.
Figure 3B:
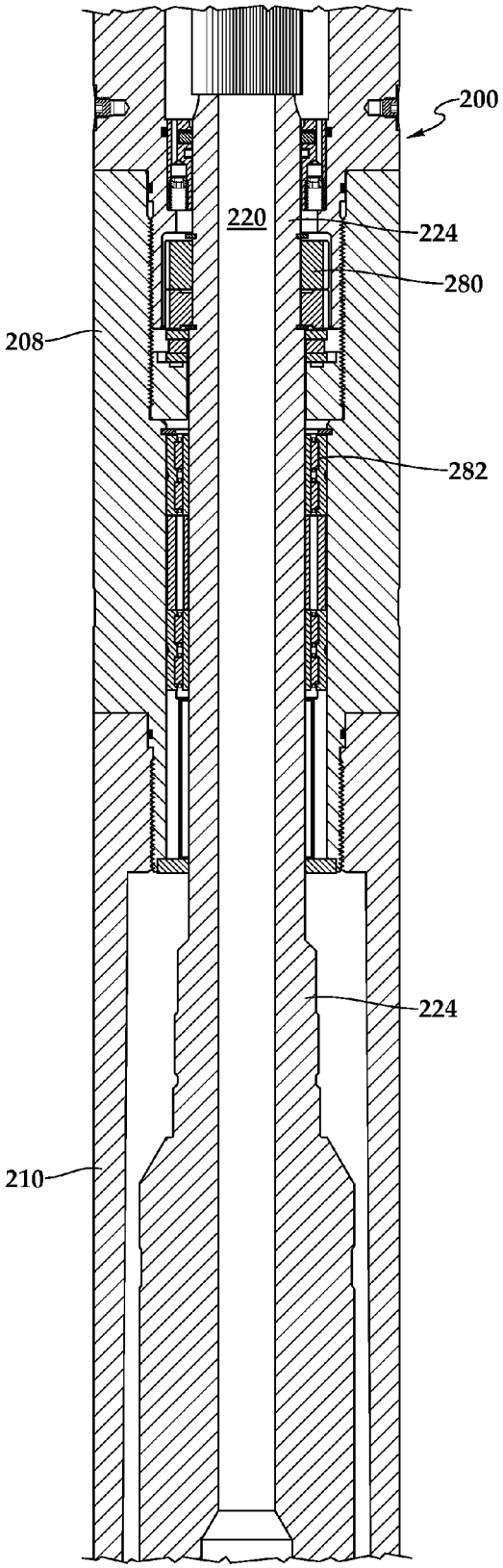
Figure 3C:
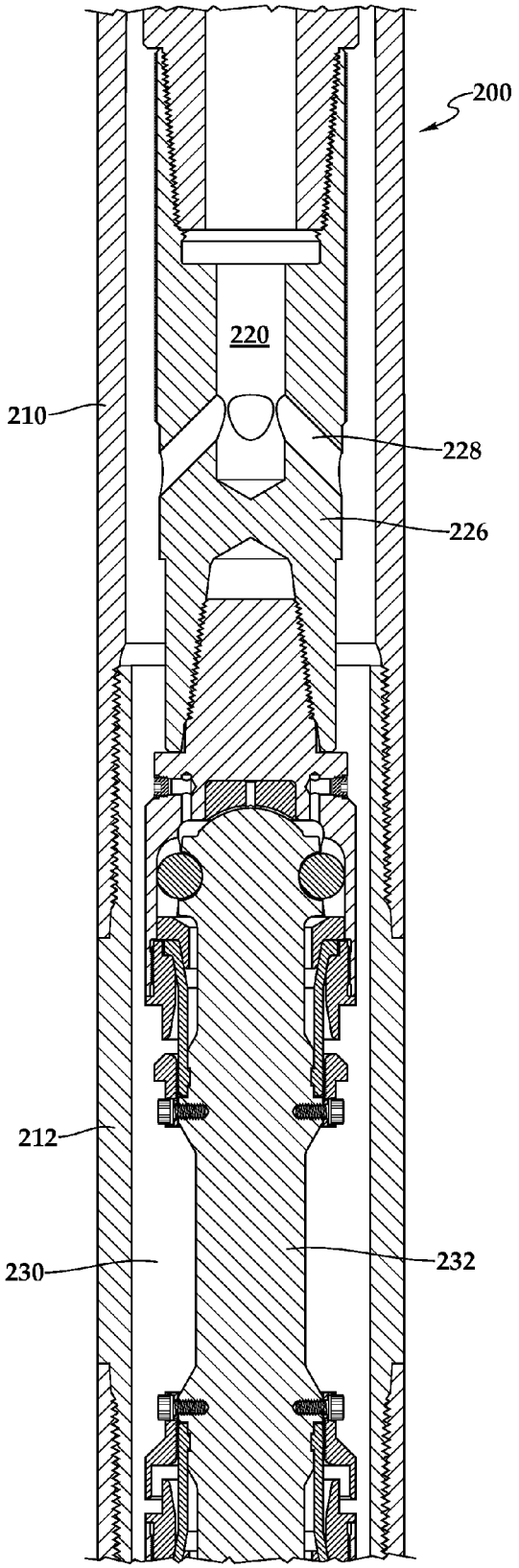
Figure 3D:
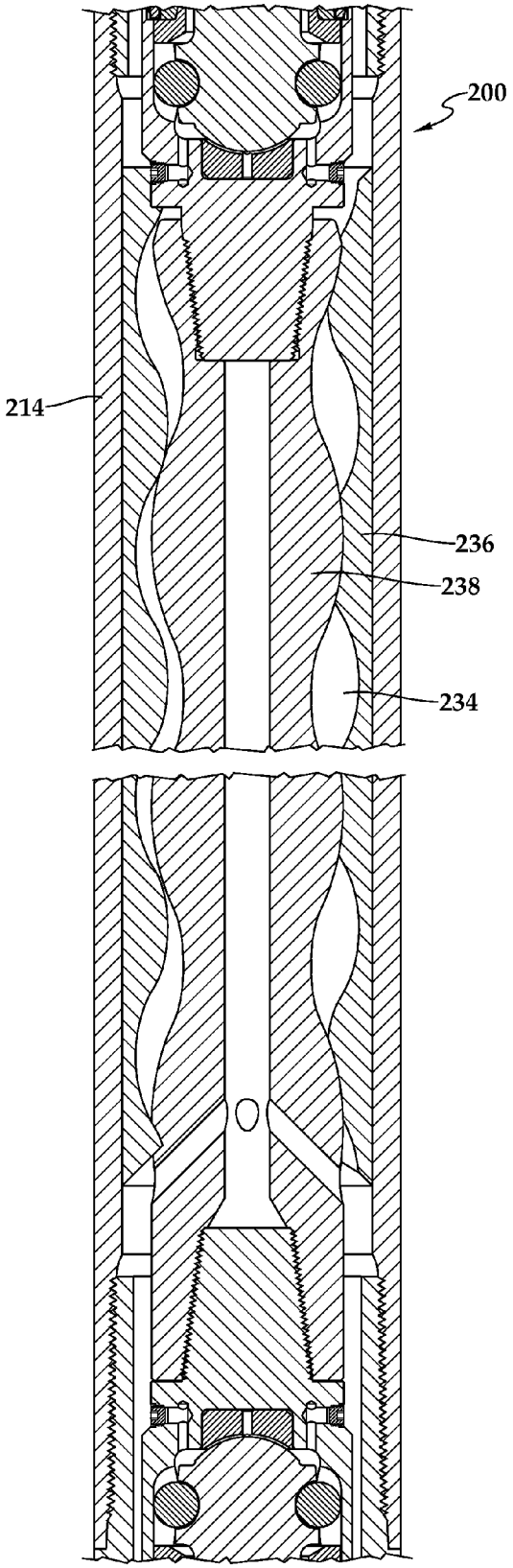
Figure 3E:
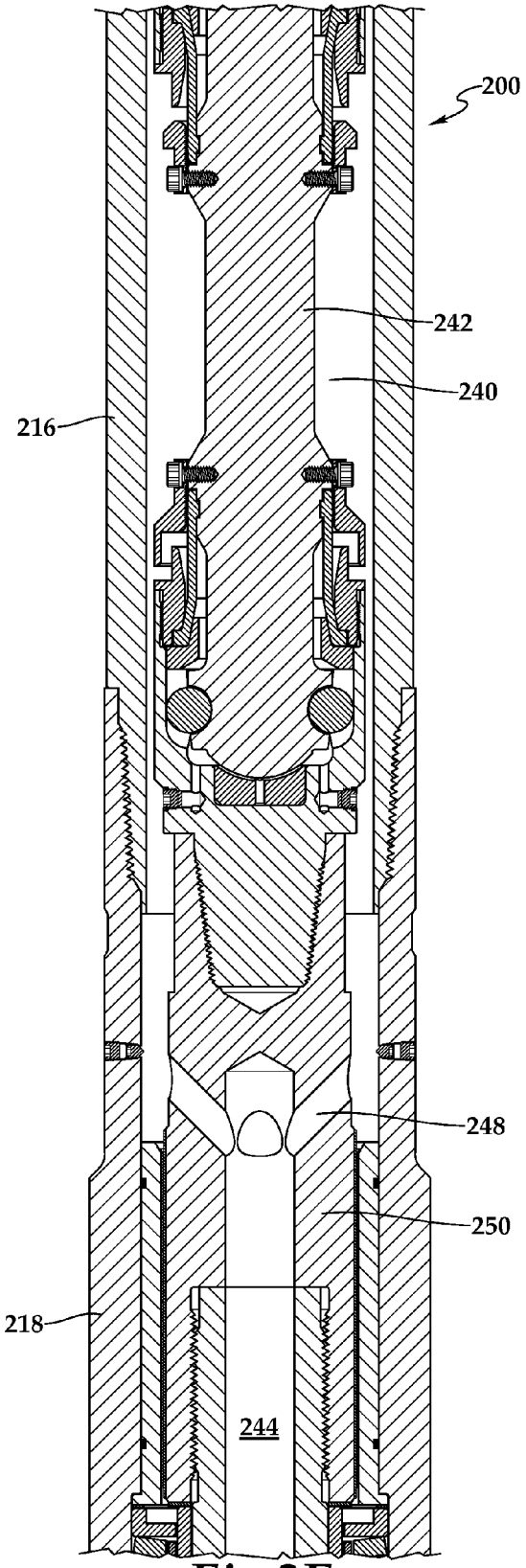
Figure 3F:
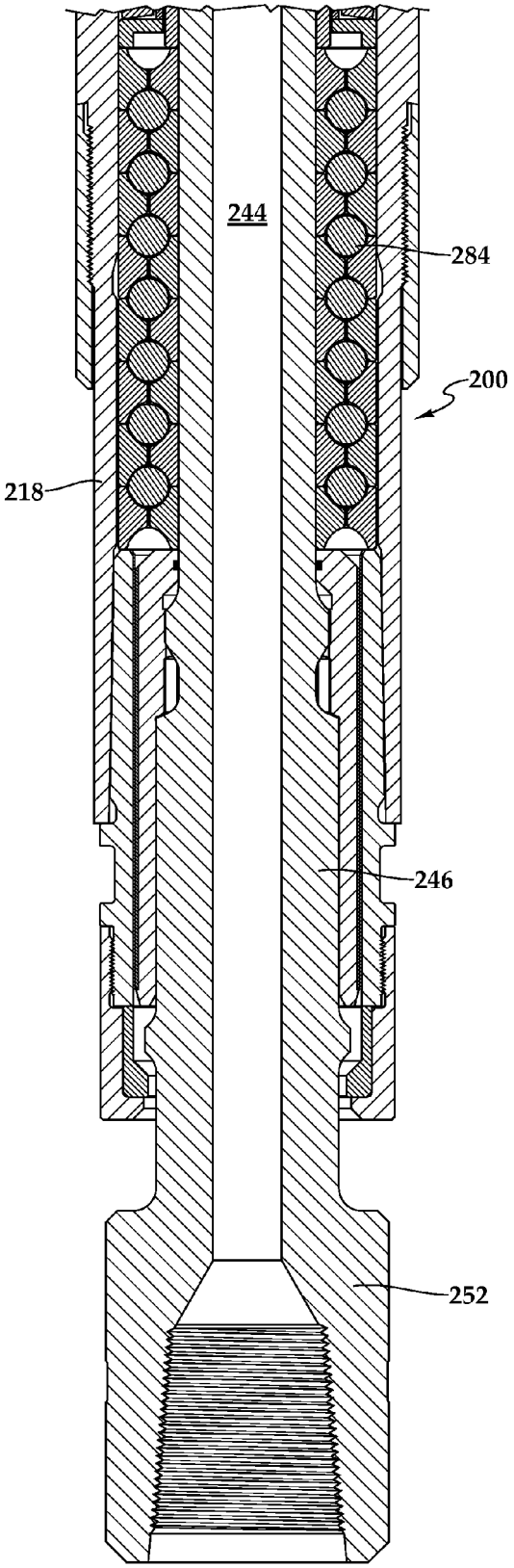

The operation of downhole drilling assembly 200 will now be described. During normal drilling operations, a circulating fluid is pumped down the inner fluid passageway of the drill string into inner fluid passageway 220 of downhole drilling assembly 200. The circulating fluid passes through inner fluid passageway 220 then enters annular region 230 via ports 228, as best seen in FIG. 3C. The circulating fluid then enters the power section of downhole drilling assembly 200, as best seen in FIG. 3D. Due to the helical lobed design of stator 236 and rotor 238, seals are created at discrete intervals therebetween, which result in the creation of axial fluid chambers or cavities 234 that are filled by the circulating fluid. The action of the circulating fluid causes rotor 238 to rotate and precess within stator 236. The circulating fluid then exits the power section and travels through annular region 240 and inner fluid passageway 244. The circulating fluid then passing through and cools the drill bit (not pictured), then returns to the surface via the wellbore annulus carrying cutting from the drilling process. Responsive to the rotation of rotor 238, universal joint 242 and connector sub 250 are rotated, which in turn rotates drive shaft 246 and the drill bit. In this manner, downhole drilling assembly 200 is operable to lengthen the wellbore. It should be noted that during normal drilling operations, rotation of rotor 238 also rotates rotor extension 224 and inner mandrel 222. As such, the rotating assembly rotates independent of the outer housing which may or may not be rotating. The relative speed of rotation between the rotating assembly and the outer housing, however, is not sufficient to generate enough oil pressure in swash plate pump assembly 256 to overcome the spring force of spring 272 to shift annular piston 270 and engage clutch 274.

In the event the drill bit becomes stuck, it may not be possible to free the drill bit with torque supplied from the power section of downhole drilling assembly 200. If the power section of downhole drilling assembly 200 is not able to free the stuck drill bit, however, downhole drilling assembly 200 is nonetheless able to free the stuck drill bit by engaging the hydraulically actuated clutch section and rotating the drill bit responsive to rotation of the drill string. More specifically, the drill string is rotated at the surface which causes the outer housing of downhole drilling assembly 200 to rotate. This rotation causes pistons 260 to be rotated about the longitudinal axis of downhole drilling assembly 200. As pistons 260 are rotated, they also reciprocate axially due to interaction with the angled surface of swash plate 258 causing a pumping action which communicates fluid from chamber 266 into chamber 268 under pressure. The pressurized fluid acts on an upper surface of annular piston 270. When the rate of rotation of swash plate pump assembly 256 is sufficient to generate the pressure required to overcome the spring force of spring 272, annular piston 270 axially shifts in the downhole direction.

Prior to this shift, upper castellated element 276 is rotating with the outer housing while lower castellated element 278 is stationary. When annular piston 270 axially shifts in the downhole direction, annular piston 270 contacts upper castellated element 276 which is shifted in the downhole direction to engage lower castellated element 278. Once engaged, the meshed castellated profiles of upper castellated element 276 and lower castellated element 278 encourage lower castellated element 278 to rotate. As lower castellated element 278 is operably coupled to the drill bit by rotor extension 224, connector sub 226, universal joint 232, rotor 238, universal joint 242, connector sub 250 and drive shaft 246, torque from rotation of the drill string is transferred to drive shaft 246 and the drill bit by hydraulically actuated clutch 274. In this configuration, the torque applied to drive shaft 246 and the drill bit from the surface via rotation of the drill string can be significantly greater than the torque which can be generated by the power section of downhole drilling assembly 200. Once the bit is freed, the relative speed of rotation between the rotating assembly and the outer housing declines which reduces the hydraulic pressure acting on the upper surface of annular piston 270. When the pressure is no longer sufficient to overcome the spring force of spring 272, annular piston 270 axially shifts in the uphole direction which disengages upper castellated element 276 from lower castellated element 278. Downhole drilling assembly 200 has now returned to its normal operating configuration such that circulating fluid pumped through downhole drilling assembly 200 causes the drill bit to rotate, thereby enabling downhole drilling assembly 200 to further lengthen the wellbore.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole drilling assembly comprising:

a drill string having an inner fluid passageway;

a fluid motor disposed within the drill string, the fluid motor having a stator and a rotor, the rotor operable to rotate relative to the stator in response to a circulating fluid received via the inner fluid passageway of the drill string;

a drive shaft operably associated with the rotor, the drive shaft rotating responsive to rotation of the rotor;

a drill bit operably associated with the drive shaft, the drill bit rotating responsive to rotation of the drive shaft; and a hydraulically actuated clutch disposed within the drill string, the clutch having a pump, a first clutch assembly operable to rotate with the drill string, and a second clutch assembly operable to rotate with the drive shaft, wherein, in a first configuration, the first clutch assembly is disengaged from the second clutch assembly such that rotation of the rotor relative to the stator causes the drive shaft and the drill bit to rotate relative to the drill string; and wherein, in a second configuration, the pump generates hydraulic pressure via rotation of the drill string relative to the drive shaft, which hydraulic pressure engages the first clutch assembly with the second clutch assembly such that the drive shaft and the drill bit rotate together with the drill string.

2. The downhole drilling assembly as recited in claim 1 wherein the pump comprises a swash plate pump generating the hydraulic pressure responsive to rotation of the drill string relative to the drive shaft.

3. The downhole drilling assembly as recited in claim 1 wherein the first clutch assembly further comprises a first clutch plate and wherein the second clutch assembly further comprise a second clutch plate.

4. The downhole drilling assembly as recited in claim 3 wherein the hydraulically actuated clutch further comprises a piston that is axially shifted responsive to the hydraulic pressure, the piston operable to shift the first clutch assembly into engagement with the second clutch assembly.

5. The downhole drilling assembly as recited in claim 1 wherein the first clutch assembly further comprises a first castellated element and wherein the second clutch assembly further comprises a second castellated element.

6. The downhole drilling assembly as recited in claim 5 wherein the hydraulically actuated clutch further comprises a piston that is axially shifted responsive to the hydraulic pressure, the piston operable to move the castellated elements into engagement with one another.

7. The downhole drilling assembly as recited in claim 6 wherein the hydraulically actuated clutch further comprises a spring that biases the castellated elements toward disengagement from one another.

8. A downhole drilling assembly comprising:

a drill string having an inner fluid passageway;

a fluid motor disposed within the drill string, the fluid motor having a stator and a rotor, the rotor operable to rotate relative to the stator in response to a circulating fluid received via the inner fluid passageway of the drill string;

a drive shaft operably associated with the rotor, the drive shaft rotating responsive to rotation of the rotor;

a drill bit operably associated with the drive shaft, the drill bit rotating responsive to rotation of the drive shaft; and a hydraulically actuated clutch disposed within the drill string, the clutch having a swash plate pump, a first clutch assembly operable to rotate with the drill string and a second clutch assembly operable to rotate with the drive shaft, wherein, in a first configuration, the first clutch assembly is disengaged from the second clutch assembly such that rotation of the rotor relative to the stator causes the drive shaft and the drill bit to rotate relative to the drill string; and wherein, in a second configuration, the swash plate pump generates hydraulic pressure via rotation of the drill string relative to the drive shaft, which hydraulic pressure engages the first clutch assembly with the second clutch assembly such that the drive shaft and the drill bit rotate together with the drill string.

9. The downhole drilling assembly as recited in claim 8 wherein the first clutch assembly further comprises a first clutch plate and wherein the second clutch assembly further comprise a second clutch plate.

10. The downhole drilling assembly as recited in claim 9 wherein the hydraulically actuated clutch further comprises a piston that is axially shifted responsive to the hydraulic pressure generated by the swash plate pump, the piston operable to shift the first clutch assembly into engagement with the second clutch assembly.

11. The downhole drilling assembly as recited in claim 8 wherein the first clutch assembly further comprises a first castellated element and wherein the second clutch assembly further comprises a second castellated element.

12. The downhole drilling assembly as recited in claim 11 wherein the hydraulically actuated clutch further comprises a piston that is axially shifted responsive to the hydraulic pressure generated by the swash plate pump, the piston operable to move the castellated elements into engagement with one another.

13. The downhole drilling assembly as recited in claim 12 wherein the hydraulically actuated clutch further comprises a spring that biases the castellated elements toward disengagement from one another.

14. A method of operating a downhole drilling assembly comprising:

disposing a drill string having an inner fluid passageway and a downhole drilling motor assembly in a wellbore;

pumping a circulating fluid through the inner fluid passageway and the downhole drilling motor assembly;

rotating a rotor of the downhole drilling motor assembly relative to a stator of the downhole drilling motor assembly responsive to the circulating fluid;

rotating a drive shaft responsive to the rotation of the rotor;

rotating a drill bit relative to the drill string responsive to the rotation of the drive shaft;

rotating the drill string relative to the drive shaft;

generating hydraulic pressure with a pump, via the rotation of the drill string relative to the drive shaft, to engage a hydraulically actuated clutch; and rotating the drill bit together with the drill string responsive to the engagement of the hydraulically actuated clutch.

15. The method as recited in claim 14 wherein engaging the hydraulically actuated clutch responsive to the rotation of the drill string relative to the drive shaft further comprises generating hydraulic pressure responsive to operating a swash plate pump.

16. The method as recited in claim 14 wherein engaging the hydraulically actuated clutch responsive to hydraulic pressure generated by the rotation of the drill string relative to the drive shaft further comprises engaging a first clutch assembly operably associated with the drill string with a second clutch assembly operably associated with the drive shaft.

17. The method as recited in claim 16 wherein engaging the first clutch assembly operably associated with the drill string with the second clutch assembly operably associated with the drive shaft further comprises engaging a first clutch plate operably associated with the drill string with a second clutch plate operably associated with the drive shaft.

18. The method as recited in claim 16 wherein engaging the first clutch assembly operably associated with the drill string with the second clutch assembly operably associated with the drive shaft further comprises engaging a first castellated element operably associated with the drill string with a second castellated element operably associated with the drive shaft.

19. The method as recited in claim 16 wherein engaging the first clutch assembly operably associated with the drill string with the second clutch assembly operably associated with the drive shaft further comprises axially shifting a piston responsive to the hydraulic pressure.

20. The method as recited in claim 16 wherein engaging the first clutch assembly operably associated with the drill string with the second clutch assembly operably associated with the drive shaft further comprises overcoming a spring force responsive to the hydraulic pressure.

* * * * *